US006500523B1

(12) United States Patent
Hirose et al.

(10) Patent No.: US 6,500,523 B1
(45) **Date of Patent: *Dec. 31, 2002**

(54) RECORDING MEDIUM, AND IMAGE FORMING METHOD EMPLOYING THE SAME

(75) Inventors: Mifune Hirose, Machida (JP); Eiichi Suzuki, Asaka (JP); Mamoru Sakaki, Yamato (JP); Masato Katayama, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/547,797

(22) Filed: Oct. 25, 1995

(30) Foreign Application Priority Data

Oct. 27, 1994 (JP) ..... 6-263721
Oct. 17, 1995 (JP) ..... 7-268638

(51) Int. Cl.[7] ..... B41M 5/00; B41J 2/01
(52) U.S. Cl. ..... 428/195; 347/105
(58) Field of Search ..... 428/195, 211, 428/537.5, 329–331; 347/105

(56) References Cited

U.S. PATENT DOCUMENTS

| | | | | | |
|---|---|---|---|---|---|
| 4,542,059 | A | | 9/1985 | Toganoh et al. | 428/141 |
| 4,554,181 | A | | 11/1985 | Cousin et al. | 427/261 |
| 4,636,805 | A | | 1/1987 | Taganoh et al. | 346/1.1 |
| 4,664,952 | A | | 5/1987 | Arai et al. | 427/256 |
| 4,686,118 | A | | 8/1987 | Arai et al. | 427/261 |
| 4,723,129 | A | | 2/1988 | Endo et al. | 346/1.1 |
| 4,740,796 | A | | 4/1988 | Endo et al. | 346/1.1 |
| 4,758,461 | A | * | 7/1988 | Akiya et al. | 428/212 |
| 4,785,313 | A | | 11/1988 | Higuma et al. | 346/135.1 |
| 4,832,984 | A | | 5/1989 | Hasegawa et al. | 427/161 |
| 4,877,680 | A | | 10/1989 | Sakaki et al. | 428/332 |
| 4,910,084 | A | | 3/1990 | Yamasaki et al. | 428/411.1 |
| 4,956,223 | A | | 9/1990 | Arai et al. | 428/212 |
| 4,965,612 | A | | 10/1990 | Sakaki et al. | 346/1.1 |
| 5,041,328 | A | | 8/1991 | Akiya et al. | 428/212 |
| 5,081,470 | A | | 1/1992 | Kurabayashi et al. | 346/1.1 |
| 5,101,218 | A | | 3/1992 | Sakaki et al. | 346/1.1 |
| 5,122,814 | A | | 6/1992 | Endo et al. | 346/33 R |
| 5,126,010 | A | | 6/1992 | Kobayashi et al. | 162/135 |
| 5,132,146 | A | * | 7/1992 | Maruyama et al. | 427/261 |
| 5,137,778 | A | | 8/1992 | Nakatsugawa et al. | 428/330 |
| 5,159,349 | A | | 10/1992 | Endo et al. | 346/33 A |
| 5,182,175 | A | | 1/1993 | Sakaki et al. | 428/537.5 |
| 5,246,774 | A | | 9/1993 | Sakaki et al. | 428/323 |
| 5,266,383 | A | | 11/1993 | Sakaki et al. | 428/195 |
| 5,277,962 | A | | 1/1994 | Nakatsugawa et al. | 428/206 |
| 5,279,885 | A | * | 1/1994 | Ohmori et al. | 428/195 |
| 5,338,597 | A | | 8/1994 | Kurabayashi et al. | 428/195 |
| 5,362,558 | A | | 11/1994 | Sakaki et al. | 428/323 |
| 5,526,031 | A | | 6/1996 | Kurabayashi | 347/105 |

FOREIGN PATENT DOCUMENTS

| | | |
|---|---|---|
| CA | 2007373 | 1/1990 |
| DE | 3640359 A1 | 5/1987 |
| DE | 4307241 | 9/1994 |
| EP | 0164196 A1 | 12/1985 |
| EP | 0199874 A1 | 11/1986 |
| EP | 0379964 A1 | 8/1990 |
| EP | 0387893 | 9/1990 |

(List continued on next page.)

*Primary Examiner*—Pamela R. Schwartz
(74) *Attorney, Agent, or Firm*—Fitzpatrick, Cella, Harper & Scinto

(57) ABSTRACT

A recording medium is provided which has an ink-receiving layer mainly composed of an inorganic pigment and a binder on one face of an ink-absorbent base sheet, and a cationic substance applied on, or impregnated into, the reverse face of the base sheet.

14 Claims, 3 Drawing Sheets

FOREIGN PATENT DOCUMENTS

| | | |
|---|---|---|
| EP | 0495430 | 7/1992 |
| EP | 0600245 | 6/1994 |
| FR | 2257738 | 8/1975 |
| GB | 1486852 | 9/1977 |
| JP | 51-13244 | 2/1976 |
| JP | 54-59936 | 5/1979 |
| JP | 56-99693 | 8/1981 |
| JP | 59-35977 | 2/1984 |
| JP | 59-162561 | 9/1984 |
| JP | 59-191068 | 10/1984 |
| JP | 60-220750 | 11/1985 |
| JP | 61-58788 | 3/1986 |
| JP | 1-135682 | 5/1989 |
| JP | 1-190483 | 7/1989 |
| JP | 4-75140 | 3/1992 |

* cited by examiner

RECORDING MEDIUM, AND IMAGE FORMING METHOD EMPLOYING THE SAME

BACKGROUND OF THE INVENTION

1. Field of the Invention

The present invention relates to a recording medium for color recording, particularly ink-jet color recording, and to an image-forming method employing the recording medium. The present invention also relates to a recording medium suitable for post cards, and other cards.

2. Related Background Art

The ink-jet recording method is attracting attention because of its suitableness for high speed recording, color printing, and high density recording. Therefore, ink-jet recording apparatuses are widely used. The recording sheets for ink-jet recording are exemplified by those which are disclosed in Japanese Patent Applications Laid-Open Nos. 59-35977, 1-135682 and so forth.

With popularization of color-recording apparatus, post cards and other cards are wanted which are suitable for easy printing of an original color image.

In printing on a post card or a similar card, the card as the recording medium is required to have the following properties: (1) recording characteristics suitable for ink-jet recording with sharpness and density of image comparable with conventional printing, and preferably surface gloss at least on one face, (2) capability of forming a sharp image by ink-jet recording, and also suitability for writing with a conventional aqueous pen, ball point pen, pencil, or fountain pen, (3) no penetration of ink being caused to the reverse face when an image is recorded on either face of the recording medium, (4) no feathering being caused even when a drop of water like rain water is brought into contact for hours with the recording medium, and (5) no percolation of re-dissolved recording agent to the reverse face being caused even when a drop of water is brought into contact with the recording medium for hours.

SUMMARY OF THE INVENTION

An object of the present invention is to provide a recording medium useful as post cards and other cards, having the aforementioned required properties.

Another object of the present invention is to provide an image-forming method which enables easy formation of original color images on a post card or other kinds of cards at a low cost by ink-jet recording.

According to an aspect of the present invention, there is provided a recording medium having an ink-receiving layer mainly composed of an inorganic pigment and a binder on one face of an ink-absorbent base sheet, and a cationic substance applied or impregnated onto or into the other face of the base sheet.

According to another aspect of the present invention, there is provided an image-forming method comprising applying an ink containing at least a water-soluble dye having an anionic group onto the aforementioned recording medium.

DETAILED DESCRIPTION OF THE PREFERRED EMBODIMENTS

Figure 1:
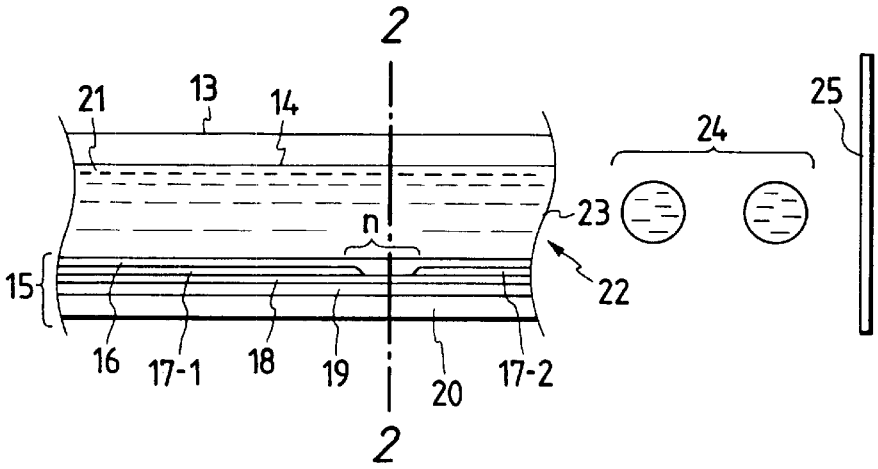
FIG. 1 is a vertical sectional view of a head portion of an ink-jet recording apparatus employed in the present invention.

The recording medium of the present invention is composed of a base sheet, an ink-receiving layer formed on one face of the base sheet, and a cationic substance applied onto the other face reverse to the ink-receiving layer.

The ink for the image-forming method of the present invention contains essentially a water-soluble dye having at least an anionic group.

The base sheet employed in the present invention is mainly composed of chemical pulp such as LBKP and NBKP, a size, and a filler, and is formed into a sheet, by using a paper-making auxiliary agent if necessary, in a conventional paper-making process. The pulp employed may additionally contain, or mainly be composed of mechanical pulp, or waste paper-regenerated pulp.

The size includes rosin sizes, alkylketene dimers, alkenylsuccinic acid anhydrides, petroleum resin type sizes, epichlorohydrin, acrylamide, and the like. The filler includes calcium carbonate, kaolin, talc, titanium dioxide, and the like. Surface sizing treatment may be conducted, if necessary.

The base sheet employed in the present invention is required to have appropriate ink absorbency, having preferably a Stöckigt sizing degree ranging from 0 to 15 seconds. A base sheet of less ink-absorbency requires a larger amount of coating on the both faces thereof in order to obtain sufficient ink absorbency in ink-jet recording. The larger amount of coating would undesirably cause difficulty and high cost in production, poor suitability for writing with usual writing tools, poor ability to be handled for use for post cards or other kinds of cards, impairment of the recorded image caused by falling-off of the coat layer by folding or surface scratching, generation of paper dust, and so forth.

The basis weight of the base sheet ranges preferably from 100 g/m$^2$ to 200 g/m$^2$. The basis weight of the recording medium may preferably be in the range of from 120 g/m$^2$ to 200 g/m$^2$. Since the base sheet itself is ink-absorbent, the recording medium of a basis weight of less than 120 g/m$^2$ is liable to cause undesired phenomena such as waving or cockling of the printed portion having received the ink, penetration of ink to the reverse face, namely strike-through, and percolation of re-dissolved recording agent by deposited water drops to the reverse face. The recording medium having a basis weight of more than 200 g/m$^2$ is too stiff, tending to exhibit low deliverability in a recording apparatus.

The ink-receiving layer formed on the base sheet contains a binder. The binder includes casein; starch; a cellulose derivative such-as carboxymethylcellulose, and hydroxymethylcellulose; a hydrophilic resin capable of being swelled by ink such as polyvinyl alcohol, polyvinylpyrrolidone, sodium polyacrylate, and polyacrylamide; a resin having hydrophilic portions and hydrophobic portions in the molecule such as SBR latexes, acrylic emulsions, and styrene-acrylate copolymers.

The recording medium of the present invention essentially contains an inorganic pigment in the ink-receiving layer. An organic pigment may be used in combination with the inorganic pigment.

The inorganic pigment includes silica, alumina, aluminum silicate, magnesium silicate, hydrotalcite, calcium carbonate, titanium oxide, clay, talc, and magnesium (basic) carbonate, but is not limited thereto. The organic pigment includes plastic pigments such as urea resins, urea-formalin resins, polyethylene resins, and polystyrene resins, but is not limited thereto.

A water-repellent substance such as silicone oil, paraffin, wax, and fluorine compounds, or the aforementioned size may additionally be used.

The ink-receiving layer may further contain, if necessary, an additive such as a dye-fixing agent, a fluorescent whitener, a surfactant, an antifoaming agent, a pH adjusting agent, an antiseptic agent, a UV absorber, an antioxidant, a dispersant, and a viscosity-reducing agent. Such an additive may be selected from known substances as required.

The total amount of the applied pigment in the ink-receiving layer ranges preferably from 0.1 $g/m^2$ to 50 $g/m^2$, more preferably from 0.1 $g/m^2$ to 20 $g/m^2$. With a smaller amount of the pigment, the surface of the base sheet may be covered incompletely. At an amount of pigment of less than 0.1 $g/m^2$, the ink-receiving layer is not effective in color development of the dye in comparison with the case of no ink-receiving layer. At an amount of pigment of more than 50 $g/m^2$, the coat layer is likely to cause falling off of powder.

The recording medium of the present invention has essentially a cationic substance applied or impregnated onto or into the face of the base sheet reverse to the ink-receiving layer.

The cationic substance on the reverse face of the base sheet improves the water-fastness and the image density of the recorded image. The cationic substance may be either a low-molecular cationic substance or a high-molecular cationic substance as shown below. Complete water-fastness is obtained by combination of a low-molecular cationic substance having a weight-average molecular weight of not higher than 1000, preferably from 100 to 700, and a high-molecular cationic substance of weight-average molecular weight of not lower than 2000, preferably from 2000 to 10,000.

In the present invention, when ink is brought into contact with the combination of the low-molecular cationic substance of molecular weight of not higher than 1000 and the high-molecular cationic substance mentioned above on the recording medium or at the site of penetration, the low-molecular cationic substance is re-dissolved in the ink. Thereby, the low-molecular cationic substance will associate with dye in the ink by ionic interaction, and be separated from the solution phase instantaneously as the first step of reaction of the recording medium with the ink.

Then, as the second step of the reaction, the association product of the low-molecular cationic substance with the dye is adsorbed by the high-molecular cationic substance of molecular weight of not lower than 2000, resulting in increase in dimension of the dye agglomerate formed by the association. Therefore, the dye does not readily penetrate into interstices between fibers of the recording medium, and only the liquid portion after the solid-liquid separation penetrates into the recording medium. Thereby, image quality and ink fixability are both improved. Further, since the agglomerate formed from the low-molecular cationic substance, the anionic dye and the high-molecular substance of molecular weight of not lower than 2000 as mentioned above has an extremely high viscosity, the agglomerate will not migrate with the liquid medium. Consequently, color mixing, or bleeding, will not occur between adjacent dots of different colors in color printing like the aforementioned full color image formation. The agglomerate is inherently water-insoluble, rendering the water-fastness of the formed image perfect.

The low-molecular cationic substance having a molecular weight of not higher than 1000 specifically includes hydrochlorides and acetates of primary, secondary, and tertiary amines such as laurylamine, coconut-amine, stearylamine, and rosin-amine; quaternary ammonium compounds such as lauryltrimethylammonium chloride, lauryldimethylbenzylammonium chloride, benzyltributylammonium chloride, and benzalkonium chloride; pyridinium type compounds such as cetylpyridinium chloride, and cetylpyridinium bromide; imidazoline type cationic compounds such as 2-heptadecenyl-hydroxyethylimidazoline; and ethylene oxide adducts of higher alkylamines such as dihydroxyethylstearylamine. Further, in the present invention, an amphoteric surfactant may be used which is cationic in a certain pH region. More specifically, the amphoteric surfactant includes carboxylate salt type amphoteric surfactants such as amino acid type amphoteric surfactants, compounds of R—NH—$CH_2$—$CH_2$—COOH type, and betaine type compounds like stearyldimethyl-betaine and lauryldihydroxyethylbetaine; sulfate ester type amphoteric surfactants, sulfonate salt type amphoteric surfactant, and phosphate ester type amphoteric surfactants. Naturally, such a type of amphoteric surfactant should be used with a recording medium having a pH of lower than the isoelectric point thereof or with an ink adjusted to have a pH of lower than the isoelectric point on mixing with the amphoteric surfactant.

A metallic compound may be used therefor, such as aluminum lactate, basic polyaluminum hydroxide, aluminum chloride, sodium aluminate, and aluminum acrylate. Of these metallic compounds, particularly preferred are benzalkonium chloride, benzyltributylammonium chloride, basic aluminum salts, and low-molecular polyallylamines.

The low-molecular cationic compound useful in the present invention is not limited to those mentioned above.

The function and the effect of the high-molecular weight cationic compound of molecular weight of not lower than 2000 in the present invention are described above. That is, in the second step of the reaction of the recording medium with the ink, the association product of the low-molecular cationic substance with the dye is adsorbed by the high-molecular cationic substance of molecular weight of not lower than 2000, resulting in an increase in dimension of the dye agglomerate formed by the association. Therefore, the dye cannot readily penetrate into interstices between fibers of the recording medium, and only the liquid portion resulting from the solid-liquid separation penetrates into the recording medium. Thereby, image quality and ink fixability are both improved.

The high-molecular cationic substance, which has a molecular weight of not lower than 2000, is sufficiently effective in practicing the present invention. The molecular weight is preferably in the range of from 2000 to 10,000 for obtaining high image density. Without the low-molecular cationic substance of molecular weight of not higher than 1000, the effect of the association is low. Without the high-molecular cationic substance of molecular weight of not lower than 2000, the effect of the agglomeration is insufficient.

As described above, the use of a combination of two kinds of cationic substances leads to a higher degree of water-fastness.

The high-molecular cationic substance having a molecular weight of not lower than 2000 specifically includes polyallylamine and salts thereof, e.g., hydrochloride; polyaminesulfonic acid and salts thereof, e.g., hydrochloride; polyvinylamine and salts thereof, e.g., hydrochloride; chitosan and salts thereof, e.g., acetate, but is not limited thereto. The type of salt thereof is not limited to hydrochloride and acetate.

The high-molecular cationic substance may be prepared by partially cationizing a nonionic high-molecular substance. Specific examples thereof include a copolymer of vinylpyrrolidone and a quaternary salt of an aminomethylalkyl acrylate, a copolymer of acrylamide and a quaternary salt of aminomethylacrylamide, and the like, but are not limited thereto. Of the above compounds, particularly preferred are polyallylamine salts, chitosan salts, and cationic acrylamides.

The aforementioned high-molecular substance or the cationic high-molecular substance is preferably water-soluble, but may be dispersible in a state of a latex or an emulsion.

The ratio of the low-molecular cationic substance to the high-molecular cationic substance is preferably in the range of from 20/1 to 1/20 by weight. Within this range, the recorded image has higher water-fastness as well as higher image quality and higher image density.

The cationic component is contained in the recording medium preferably in an amount of from 0.05 $g/m^2$ to 7 $g/m^2$. At an amount lower than 0.05 $g/m^2$, the effect of the cationic substance is not achieved, whereas at an amount higher than 7 $g/m^2$, the ink absorbency is lower and bleeding is likely to occur. More preferably the applied amount is in the range of from 0.3 to 3 $g/m^2$. At an amount less than 0.3 $g/m^2$, the bleeding and the water-fastness are not improved sufficiently, whereas at an amount more than 3 $g/m^2$, the light-fastness and the image density tend to be lower.

An inorganic pigment or an organic pigment may be used in combination with the cationic substance.

The recording medium of the present invention is prepared from the above materials.

The recording medium may be prepared by firstly applying a cationic substance and then forming an ink-receiving layer on a base sheet, or in another way, by firstly forming an ink-receiving layer on a face of a base sheet and then applying a cationic substance on the other face thereof.

The cationic substance may be applied onto a base sheet in a mixture with the aforementioned surface-sizing aqueous coating liquid. Otherwise, the cationic substance contained in a liquid may be applied or impregnated onto or into a base sheet after application and drying of the aqueous coating liquid on a substrate.

In preparation of the ink-receiving layer, an aqueous coating liquid containing a pigment, a binder, and other additives as mentioned above is applied on the surface of a base sheet by a conventional method such as a roll coater method, a blade coater method, an air knife coater method, a gate roll coater method, a size press method, and a shim size method, and subsequently the coated matter is dried by an air drier, a heating drum, or the like. Further the resulting recording medium may be supercalendered for smoothing or strengthening of the surface.

For imparting gloss to the surface of the ink-receiving layer, casting treatment of the outermost layer is preferred to the supercalender treatment.

The casting treatment includes a wet casting method in which an undried wet coated layer is pressed against a mirror-polished heated finishing face; a re-wetting casting method in which a dried coated layer is again wetted to plasticize it and is pressed against a mirror-polished heated finishing face; and a gel casting method in which a wet coated layer is brought into a gelled state and is pressed against a mirror-polished heated finishing face. The casting methods are most suitable for gloss finish, but other methods may be employed.

Figure 5:
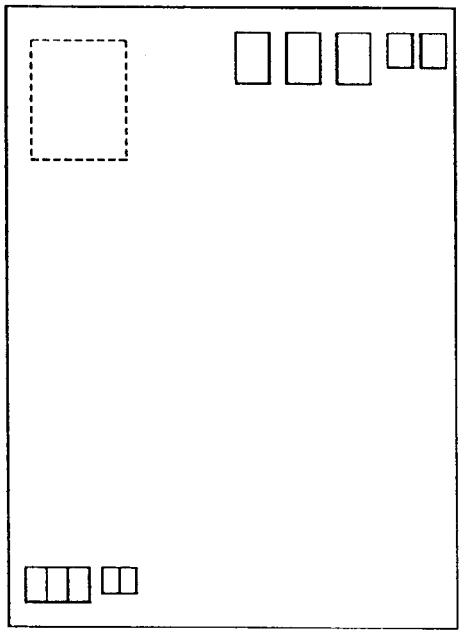
FIG. 5 is a plan view of a post card employing the recording medium of the present invention.
Figure 6:
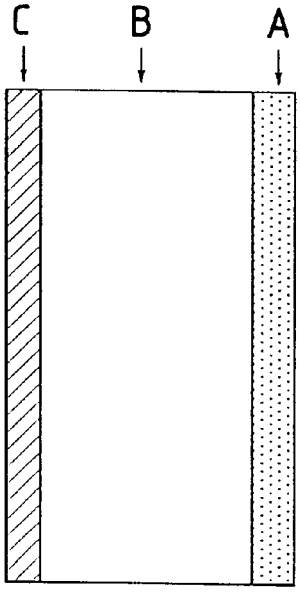
FIG. 6 is a sectional view of the post card shown in FIG. 5.

FIG. 5 shows an example of a post card employing the recording medium thus prepared of the present invention. FIG. 6 shows a cross-section of the post card.

In FIG. 6, the recording medium comprises an ink-receiving layer A, a base paper B, and a layer C containing a cationic substance. For example, an image is formed on the face of layer A by color ink-jet recording, and an address is written on the face of layer C. The border lines for the post code and the postage stamp may be printed by ink-jet recording or offset printing.

The ink used in the present invention is described below.

The ink comprises a water-soluble dye having an anionic group, water, and a water-soluble organic solvent, and, if necessary, an additive such as a viscosity controlling agent, a pH-controlling agent, an antiseptic agent, a surfactant, an antioxidant, or the like.

The water-soluble dye having an anionic group used in the present invention may be selected from the water-soluble dyes of acid dyes, direct dyes, and reactive dyes listed in the Color Index without any limitation. Further, any dye having an anionic group such as a sulfonic group and a carboxylic group may be used without limitation even though it is not listed in the Color Index. The water-soluble dye herein includes, of course, those having a pH-dependent solubility.

The water-soluble organic solvent for the ink includes amides such as dimethyl formamide and dimethylacetamide; ketones such as acetone; ethers such as tetrahydrofuran and dioxane; polyalkylene glycols such as polyethylene glycol and polypropylene glycol; glycols such as ethylene glycol, propylene glycol, butylene glycol, triethylene glycol, 1,2,6-hexanetriol, thiodiglycol, hexylene glycol, and diethylene glycol; lower alkyl ethers of polyhydric alcohols such as ethylene glycol monomethyl ether, diethylene glycol monomethyl ether, and triethylene glycol monomethyl ether, monohydric alcohols such as ethanol, isopropyl alcohol, n-butyl alcohol, and isobutyl alcohol; and glycerin, N-methyl-2-pyrrolidone, 1,3-dimethyl-imidazolidinone, triethanolamine, sulfolane, dimethylsulfoxide, and the like. The content of the above water-soluble organic solvent in the ink is preferably in the range of from 1% to 50% by weight, more preferably from 2% to 30% by weight, but is not limited thereto.

The ink may contain, if necessary, other additives such as a viscosity-adjusting agent, a pH-controlling agent, an antiseptic agent, a surfactant, an antioxidant, an evaporation accelerator, and the like. The selection of the surfactant is particularly important for controlling the penetration of the liquid.

The ink has preferably the following properties at around 25° C.: a pH of from 3 to 12, a surface tension of from 10 to 60 dyn/cm, and a viscosity of from 1 to 30 cp. More preferably, the surface tension of the respective color inks of yellow, magenta, and cyan is in the range of from 25 to 40 dyn/cm in view of rapid ink absorption and of clear image formation without ink running.

For achieving the effects of the present invention more effectively, the ink may contain, in addition to the above mentioned components, an anionic surfactant, or an anionic high-molecular substance, or the aforementioned amphoteric surfactant adjusted to a pH above the isoelectric point. Any usual anionic surfactant including carboxylate salt type surfactants, sulfate ester type surfactants, sulfonate acid type surfactants, and phosphate ester type surfactants may be used without disadvantages. The useful anionic high-molecular substance includes alkali-soluble resins such as sodium polyacrylate, and copolymers of acrylic acid with another monomer, but is not limited thereto.

The ink-jet recording system is explained below.

The image forming method of the present invention is applicable to any known ink-jet recording system which ejects droplets of an ink through a nozzle to apply ink onto the recording medium. A typical example of the effective ink-jet recording system is disclosed in Japanese Patent Application Laid-Open No. 54-59936, in which thermal energy is given to the ink to cause an abrupt change of the volume of the ink and to eject ink from a nozzle by the phase change energy.

Figure 2:
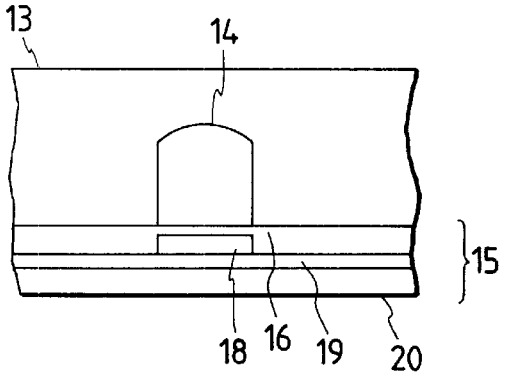
FIG. 2 is a lateral sectional view of a head portion of an ink-jet recording apparatus employed in the present invention.
Figure 3:
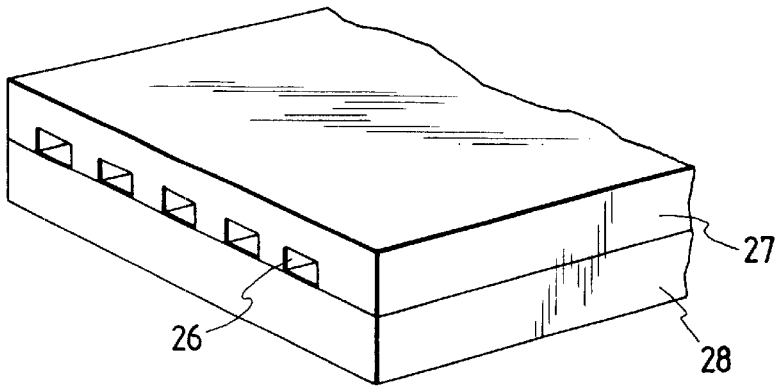
FIG. 3 is a perspective external view of a head portion constructed by multiplication of the heads shown in FIGS. 1 and 2.

An example in the ink-jet recording apparatus which is suitable for ink-jet recording of the present invention is explained by reference to the drawings. FIGS. 1, 2, and 3 illustrate examples of the construction of a head which is the essential part of the apparatus.

In these drawings, a head 13 is constructed by bonding a plate of glass, ceramics, plastics, or the like having grooves 14 for ink flow with a heat-generating head 15 for thermal recording. (The heat-generating head is not limited to the one shown in the drawings.) The heat-generating head 15 is made of a protection layer 16 formed from silicon oxide or the like; aluminum electrodes 17-1, 17-2; a heat-generating resistance layer 18 made of nichrome or the like; a heat-accumulating layer 19; and a heat-radiating substrate plate 20 made of alumina or the like.

The ink 21 fills an ejection orifice (fine nozzle) 22, and has a meniscus 23 formed by a pressure P.

On application of electric signal information to the electrodes 17-1, 17-2 of the head, the region denoted by "n" on the heat-generating head 15 generates heat abruptly to form bubbles in the ink 21 near that region, the pressure of the bubble pushes out the meniscus 23 to eject the ink 21 from the orifice 22 in the shape of droplets 24. The ejected ink droplets travel toward a recording sheet 25.

FIG. 3 shows the external appearance of a multiple head integrating a plurality of heads shown in FIG. 1. The multiple head is formed by bonding a glass plate 27 having multiple grooves 26 with the heat-generating head 28 like the one shown in FIG. 1. FIG. 1 is a sectional view of the head 13 along the ink flow path, and FIG. 2 is a sectional view taken at the line 2—2 in FIG. 1.

Figure 4:
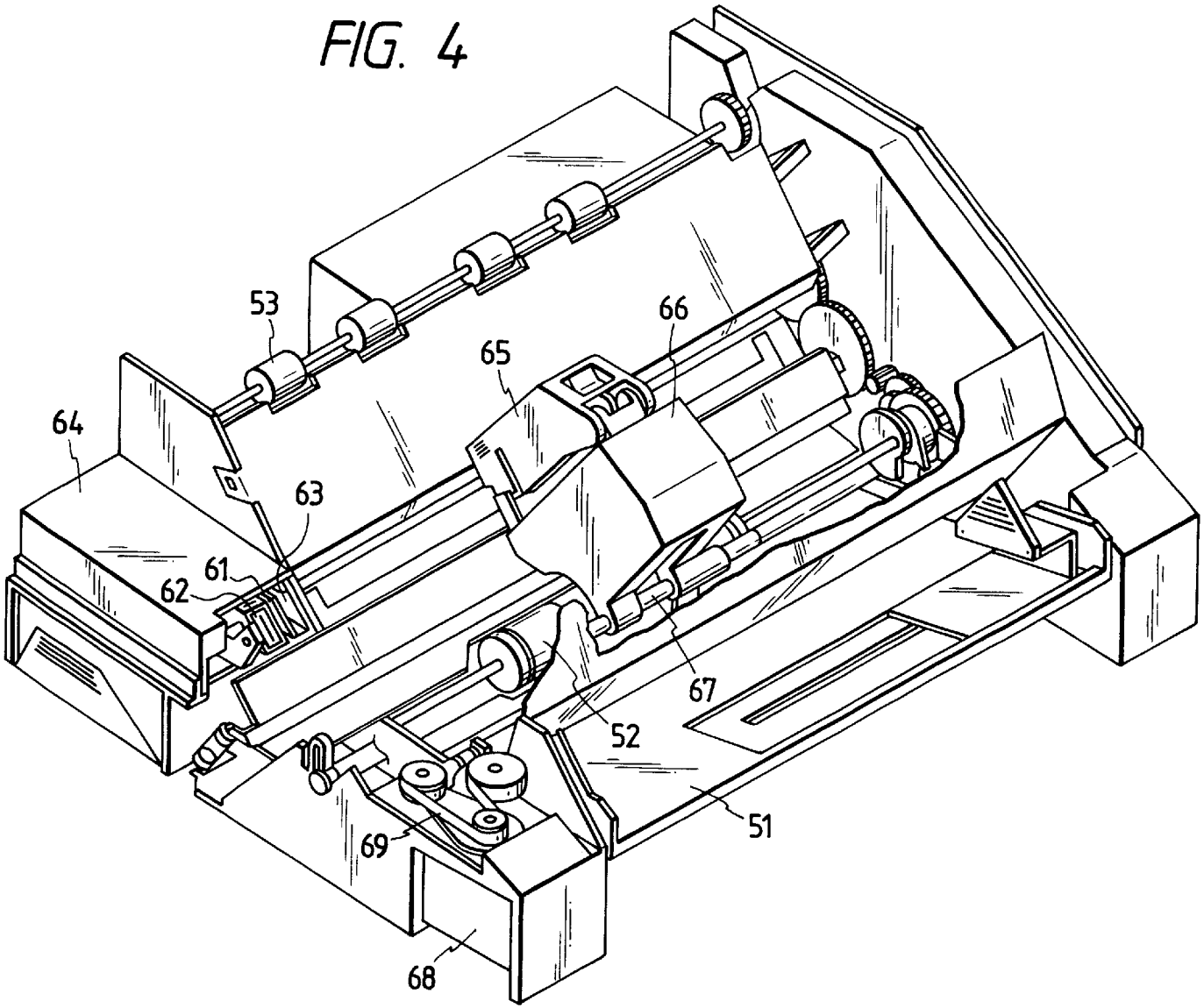
FIG. 4 is a perspective external view of an ink-jet recording apparatus.

FIG. 4 shows an example of the entire ink-jet recording apparatus equipped with the above-described head. In FIG. 4, a blade 61 as a wiping member is held at one end of the blade by a blade-holding member, forming a fixed end in the shape of a cantilever. The blade 61 is placed at a position adjacent to the recording region of the recording head, and, in this example, is held so as to protrude into the moving path of the recording head. The cap 62 is placed at a home position adjacent to the blade 61, and moves in the direction perpendicular to the moving direction of the recording head to come into contact with the ejection nozzle face to cap the nozzle. An ink absorbent 63 is placed at a position adjacent to the blade 61, and is held so as to protrude into the moving path of the recording head in a manner similar to that of the blade 61. The blade 61, the cap 62, and the absorbent 63 constitute an ejection recovery device 64. The blade 61, and the absorbent 63 serve to remove water, dust, and the like from the face of the ink ejection nozzle.

A recording head 65 has an energy-generating means for ejection, and conducts recording by ejecting the ink onto a recording medium opposite to the ejection nozzle face. A carriage 66 is provided for supporting and moving the recording head 65. The carriage 66 is engaged slidably with a guide rod 67. A portion of the carriage 66 is connected (not shown in the drawing) to a belt 69 driven by a motor 68, so that the carriage 66 is movable along the guide rod 67 to the recording region of the recording head 65 and the adjacent region thereto.

A paper sheet delivery device 51 for delivery of a recording medium and a paper sheet delivery roller 52 driven by a motor (not shown in the drawing) delivers a recording medium to the position opposite to the ejection nozzle face of the recording head, and the recording medium is delivered with the progress of the recording to a paper discharge device provided with paper sheet-discharging rollers 53.

In the above construction, when the recording head 65 returns to the home position on completion of recording, the cap 62 of the ejection-recovery device 64 is positioned out of the moving path of the recording head 65, and the blade 61 is allowed to protrude into the moving path. Thereby, the ejection nozzle face of the recording head 65 is wiped. To cap the ejection face of the recording head 65, the cap 62 protrudes toward the moving path of the recording head to come into contact with the ejection nozzle face.

When the recording head 65 is made to move from the home position to the record-starting position, the cap 62 and the blade 61 are at the same position as in the above-mentioned wiping step, so that the ejection nozzle face of the recording head 65 is wiped also in this movement.

The recording head is moved to the home position not only at the completion of the recording and at the time of ejection recovery, but is also moved at predetermined intervals during recording from the recording region. The nozzle is wiped by such movement.

For color printing by ink-jet recording, four recording heads holding respectively inks of black, cyan, magenta, and yellow are juxtaposed horizontally or vertically on the carriage 66. The inks may be three colors of cyan, magenta, and yellow in place of the four colors.

The present invention is described below in more detail by reference to examples. The term "parts" in the Examples is based on weight unless otherwise mentioned.

EXAMPLE 1

(Preparation of Recording Paper Base Sheet)

A mixture of 80 parts of LBKP and 20 parts of NBKP was beaten to C.S.F of 430 mL for use as the starting pulp. Thereto, were mixed 10 parts of kaolin (produced by Tsuchiya Kaolin K.K.), 0.4 part of cationized starch, 0.2 part of polyacrylamide (produced by Harima Kasei K.K.), and 0.1 part of neutral rosin sizing agent (Size Pine NT, produced by Arakawa Kagaku K.K.). From the mixtures, Recording Paper Base Sheet L of a basis weight of 190 g/m$^2$ was prepared in a conventional manner.

On one face of this recording paper base sheet, the liquid prepared by mixing and dissolving the components below was impregnated, and dried to prepare Base Paper Sheet A. The amount of impregnation after drying was 2 g/m$^2$.

(Impregnation Liquid Composition A)

| | |
|---|---|
| Polyallylamine (PAA-10C, Nitto Boseki Co., Ltd.) | 0.8 part |
| Water | 99.8 parts |

Coating Liquid X for the ink-receiving layer was prepared which had the composition below. This coating liquid was applied on the other face of Base Paper Sheet A to obtain Recording Paper Sheet 1 of the present invention. The dry coating amount was adjusted to 8.0 g/m$^2$.

(Coating Liquid X for Ink-Receiving Layer)

| | |
|---|---|
| Fine powdery silica (Mizuka Sil P-78D, Mizusawa Kagaku K.K.) | 10 parts |
| Polyvinyl alcohol (PVA 117, Kuraray Co., Ltd.) | 4 parts |
| Polyallylamine hydrochloride (PAA-HCl-3L, molecular weight: 10,000, Nitto Boseki Co., Ltd.) | 0.6 part |
| Water | 85.4 parts |

The inks of yellow, magenta, cyan, and black: (1)—Y, (1)—M, (1)—C, and (1) K were prepared by mixing the components below and filtering them through a membrane filter of a pore size of 0.22 $\mu$m (Fluoropore Filter, trade name, Sumitomo Electric Industries, Ltd.) under pressure.

(1)—Y

| | |
|---|---|
| C.I. Direct Yellow 86 | 2 parts |
| Thiodiglycol | 10 parts |
| Urea | 4 parts |
| Acetylenol EH | 0.1 part |
| Water | balance |

(1)—M

The same as (1)—Y above except that the dye was replaced by 2.5 parts of C.I. Acid Red 35.

(1)—C

The same as (1)—Y above except that the dye was replaced by 2.5 parts of C.I. Direct Blue 199.

(1)—K

The same as (1)—Y above except that the dye was replaced by 3 parts of C.I. Food Black 2.

On the resulting recording paper sheet, a color image was formed with the above-mentioned inks by means of a recording apparatus which was equipped with a bubble jet type recording head having 14 recording nozzles per mm and ejecting ink droplets by action of thermal energy. The recorded image was evaluated as below.

1. Surface Image Quality

On the surface of the ink-receiving layer of the recording paper sheet, solid images were printed at 100% duty and 200% duty adjacent to each other. The sharpness at the borders between the respective colors was evaluated visually. The recording paper sheets on which sharp border lines were observed were evaluated as "Good", and those on which the border lines were not sharp were evaluated as "Poor" in surface image quality.

2. Image Density

On the face of the recording paper sheet reverse to the ink-receiving layer, a solid image was printed with the black ink at 100% duty. After being left standing for 12 hours, the printed solid image was subjected to measurement of its reflection density by means of a reflection densitometer, MacBeth RD-918 (MacBeth Co.).

3. Water-fastness

Onto the characters printed at 100% duty on the face of the recording paper reverse to the ink-receiving layer, a drop of water was allowed to fall from a dropping pipet, and was dried spontaneously. After drying, the printed characters were evaluated visually. The recording paper sheets on which the images did not run but became fat were evaluated as "Good" in water fastness. Those on which the characters did not run and did not become fat were evaluated as "Excellent". Those on which the characters ran but were decipherable were evaluated as "Fair". Those on which the characters were not decipherable were evaluated as "Poor".

4. Resistance to Percolation of Applied Ink to Front Face During Water-Fastness Test at Reverse Face Onto the solid image printed at 100% duty on the face of the recording paper sheet reverse to the ink-receiving layer, a drop of water was allowed to fall from a dropping pipet, and was dried spontaneously. The front face (ink-receiving layer surface) was examined visually. The recording paper sheets on which percolation of the once-dried ink to the front face were obvious was evaluated as "Poor" in resistance to percolation. Those on which the percolation is slight were evaluated as "Fair". Those on which the percolation was not observed at all were evaluated as "Good".

5. Color Development

The tint of magenta-, and cyan-color printed areas were examined visually. The recording papers on which the color saturation is high and the colors are clear was evaluated as "Good" in color development. Those on which the color saturation is low and the colors are dusky were evaluated as "Fair". Those on which the color saturation is low and the colors are significantly dusky were evaluated as "Poor".

6. Quality of Recorded Characters

Intricate Chinese characters were printed at 100% duty. The recording paper sheets on which sharp letters were printed were evaluated as "Good" in quality of recorded characters. Those on which the printed letters were not decipherable were evaluated as "Poor". Those on which the printed letters were of low quality but were decipherable were evaluated as "Fair".

EXAMPLE 2 and

Comparative Example 1

Impregnation Liquids B and C having the compositions below were prepared and the respective liquids were impregnated into the aforementioned Recording Paper Base Sheet L in the same manner as in Example 1 to obtain Base Paper Sheets B and C. The amount of impregnation after drying were adjusted to 2.0 g/m$^2$. Thereon, the aforementioned Coating Liquid X was applied in the same manner as in Example 1 to obtain Recording Paper Sheet 2 and Comparative Recording Paper Sheet 1.

(Impregnation Liquid Composition B)

| | |
|---|---|
| Benzalkonium chloride (G-50, Sanyo Chemical Industries Ltd.) | 0.2 part |

-continued

| | |
|---|---|
| Polyallylamine (PAA-10C, Nitto Boseki Co., Ltd.) | 0.8 part |
| Water | 99.0 parts |

(Impregnation Liquid Composition C)

Water only (Amount of application: 0 g/m$^2$)

EXAMPLE 3

Recording Paper Base Sheet N of a basis weight of 140 g/m$^2$ were prepared in the same manner as Recording Paper Base Sheet L. Impregnation Liquid D of the composition below were prepared, and Base Paper Sheet D were prepared in the same manner as in Example 1. The amount of impregnation after drying were adjusted to 2.0 g/m$^2$.

(Impregnation Liquid Composition D)

| | |
|---|---|
| Benzyltributylammonium chloride (BTBAC, Sanyo Chemical Industries, Ltd.) | 0.4 part |
| Polyallylamine (PAA-10C, Nitto Boseki Co., Ltd.) | 0.6 part |
| Water | 99.0 parts |

Coating Liquid Y for an ink-receiving layer having the composition below were applied on Base Paper Sheet D by an applicator in a dry solid amount of 10 g/m$^2$, and the applied matter were treated with aqueous 10% calcium formate. The coating film, while it was wet, were pressed and dried with a stainless roll heated at 100° C. to obtain Recording Paper Sheet 3 of the present invention having mirror gloss.

(Coating Liquid Y for Ink-Receiving Layer)

| | |
|---|---|
| Fine powdery silica (Mizuka Sil P-78D, Mizusawa Kagaku K.K.) | 6 parts |
| Polyvinyl alcohol (PVA 117, Kuraray Co., Ltd.) | 1 parts |
| Styrene-butadiene latex (Sumitomo Naugatuck K.K.) | 1 part |
| Polyallylamine hydrochloride (PAA-HCl-3L, molecular weight: 10,000, Nitto Boseki Co., Ltd.) | 0.6 part |
| Water | 91.4 parts |

EXAMPLE 4

Impregnation Liquid E having the composition below were prepared, and were impregnated into Recording Base Paper Sheet L to obtain Base Paper Sheet E. The amount of impregnation after drying were adjusted to 0.5 g/m$^2$.

Thereon, the above Coating Liquid X were applied in the same manner as in Example 1 to obtain Recording Paper Sheet 4 of the present invention. The amount of dry coating were adjusted to 8.0 g/m$^2$.

(Impregnation Liquid Composition E)

| | |
|---|---|
| Aluminum basic lactate (Takiseram G-17P, Taki Chemical Co., Ltd.) | 0.1 part |

-continued

| | |
|---|---|
| Polyallylamine hydrochloride (PAA-HCl-3L, molecular weight: 10,000, Nitto Boseki Co., Ltd.) | 0.9 part |
| Water | 99.0 parts |

EXAMPLE 5

Impregnation Liquid F having the composition below were prepared, and were impregnated into Recording Base Paper Sheet L in the same manner as in Example 1 to obtain Base Paper Sheet F. The amount of impregnation after drying were adjusted to 0.5 g/m$^2$.

Thereon, Coating Liquid Z for an ink-receiving layer having the composition below were prepared, and were applied in the same manner as in Example 1 to obtain Recording Paper Sheet 5 of the present invention. The amount of dry coating were adjusted to 8.0 g/m$^2$.

(Impregnation Liquid Composition F)

| | |
|---|---|
| Basic polyaluminum hydroxide (Paho #2S, Asada Kagaku K.K.) | 0.2 part |
| Polyallylamine hydrochloride (PAA-HCl-3L, molecular weight: 10,000, Nitto Boseki Co., Ltd.) | 0.8 part |
| Water | 99.0 parts |

(Coating Liquid Z for Ink-Receiving Layer)

The fine powdery silica in Coating Liquid X for the ink-receiving layer were replaced by fine powdery alumina (trade name: AKP-G015, Sumitomo Chemical Co., Ltd.).

EXAMPLE 6

Recording Paper Sheet 6 of the present invention were prepared in the same manner as in Example 3 except that Impregnation Liquid G having the composition below were impregnated into the aforementioned Recording Paper Base Sheet N in an amount of dry solid coating of 0.5 g/m$^2$.

(Impregnation Liquid Composition G)

| | |
|---|---|
| Aluminum acrylate (P-3, Asada Kagaku K.K.) | 0.2 part |
| Polyallylamine hydrochloride (PAA-HCl-3L, molecular weight: 10,000, Nitto Boseki Co., Ltd.) | 0.8 part |
| Water | 99.0 parts |

EXAMPLE 7

Recording Paper Base Sheet M having a basis weight of 60 g/m$^2$ were prepared in the same manner as Recording Paper Base Sheet L. Impregnation Liquid H shown below were impregnated thereto in the same manner as in Example 1 to obtain Base Paper Sheet H. The dry coating amount were adjusted to 0.5 g/m$^2$. Thereon Coating Liquid X for an ink-receiving layer were applied in the same manner as in Example 1 to obtain Recording Paper Sheet 7 of the present invention.

(Impregnation Liquid Composition H)

| | |
|---|---|
| Polyallylamine hydrochloride (PAA-HCl-3L, molecular weight: 10,000, Nitto Boseki Co., Ltd.) | 0.4 part |
| Water | 99.6 parts |

EXAMPLE 8

The aforementioned Coating Liquid X for an ink-receiving layer were applied on the aforementioned Recording Paper Base Sheet M in a dry coating amount of 8.0 g/m$^2$. Then the aforementioned Impregnation Liquid H were impregnated into the face of the recording paper base sheet reverse to the ink-receiving layer in a dry coating amount of 0.5 g/m$^2$ to obtain Recording Paper Sheet 8 of the present invention.

EXAMPLE 9

Recording Paper Sheet 9 were prepared in the same manner as in Example 7 except that the dry coating amount of Impregnation Liquid H were changed to 2.0 g/m$^2$.

The results of the Examples and the Comparative Example are summarized in Table 1.

TABLE 1

Evaluation Results of Examples 1–9 and Comparative Example 1

| | Impregnation liquid for base paper sheet | Impregnation to base paper sheet (g/m$^2$) | Basis weight of recording paper sheet (g/m$^2$) | Image quality on front face | Image density on reverse face | Water fastness on reverse face | Percolation to front face | Color development on reverse face | Character quality on reverse face |
|---|---|---|---|---|---|---|---|---|---|
| Example | | | | | | | | | |
| 1 | A | 2 | 200 | Good | 1.16 | Good | Good | Good | Good |
| 2 | B | 2 | 200 | Good | 1.23 | Excellent | Good | Good | Good |
| 3 | D | 2 | 150 | Good | 1.25 | Excellent | Good | Good | Good |
| 4 | E | 0.5 | 200 | Good | 1.07 | Excellent | Good | Fair | Fair |
| 5 | F | 0.5 | 200 | Good | 1.08 | Excellent | Good | Fair | Fair |
| 6 | G | 0.5 | 150 | Good | 1.07 | Excellent | Good | Fair | Good |
| 7 | H | 0.5 | 70 | Good | 1.06 | Fair | Fair | Fair | Fair |
| 8 | H | 0.5 | 70 | Good | 1.06 | Fair | Fair | Fair | Fair |
| 9 | H | 2 | 70 | Good | 1.12 | Good | Fair | Fair | Fair |
| Comparative Example | | | | | | | | | |
| 1 | C | 0 | 200 | Good | 0.95 | Poor | Good | Good | Poor |

As shown in the above Examples and Comparative Example, the recording medium of the present invention is capable of forming sharp color images on the one face thereof with high density and high resolution by ink-jet recording, and is also capable of forming images on the reverse face, on which no ink-receiving layer is provided, by ink-jet recording with high quality and water-fastness of the recorded images. On the reverse face, writing can be practiced similarly as on plain paper because of the absence of an ink-receiving layer. Therefore, the recording medium of the present invention is suitable for post cards and other cards. The recording mediums of Examples 1 to 9 with a cationic substance applied on the reverse face gave good water fastness of the recorded image, whereas the recording medium of Comparative Example 1 without a cationic substance gave poor water fastness of the recorded image. The recording mediums of Examples 2 to 6, where a low-molecular cationic substance of molecular weight of 1000 or lower was used in combination with a high molecular cationic substance, improved the water fastness of the recorded image in comparison with the recording mediums of Examples 1, 7, 8 and 9 where only a high-molecular cationic substance were used.

The recording paper sheets having a larger basis weight of Examples 1 to 6 did not cause percolation of re-dissolved ink to the reverse face even when water drops were deposited for hours.

As explained above, in color ink-jet recording, the recording medium of the present invention makes possible formation of original color images on post cards or similar cards easily at a low cost.

What is claimed is:

1. A recording medium having an ink-receiving layer having a glossy surface, said ink-receiving layer comprising an inorganic pigment in an amount ranging from 0.1 g/m$^2$ to 20 g/m$^2$ and a binder on one face of an ink-absorbent base sheet, and a water-soluble cationic substance impregnated into the other face of the base sheet in an amount ranging from 0.3 g/m$^2$ to 3 g/m$^2$, wherein the base sheet comprises pulp and has a basis weight in a range from 120 g/m$^2$ to 200 g/m$^2$, and wherein a first low-molecular cationic substance having a weight-average molecular weight of not higher than 1000, and a second high-molecular cationic substance having a weight-average molecular weight of not lower than 2000 are applied onto or impregnated into the other face of the base sheet.

2. The recording medium according to claim 1, wherein the first low-molecular cationic substance, and the second high-molecular cationic substance are contained at a weight ratio of from 20/1 to 1/20.

3. An image-forming method comprising applying an ink comprising a water-soluble dye having an anionic group onto the recording medium as set forth in claim 1 or 2.

4. The image-forming method according to claim 3, wherein the ink is applied to the recording medium by ejecting the ink as liquid droplets from an orifice in accordance with recording signals.

5. The image-forming method according to claim 3, wherein the ink is of a color selected from the group consisting of yellow, cyan, magenta and black.

6. The image-forming method according to claim 3, wherein the ink is applied onto the recording medium by an ink-jet recording system.

7. The image-forming method according to claim 6, wherein the ink-jet recording system ejects ink by action of thermal energy on the ink.

8. The recording medium according to claim 1, wherein the base sheet has a Stöckigt sizing degree ranging from 0 to 15 seconds.

9. The recording medium according to claim 1, wherein the low-molecular cationic substance has a weight-average molecular weight of from 100 to 700.

10. The recording medium according to claim 1, wherein the high-molecular cationic substance has a weight-average molecular weight of from 2,000 to 10,000.

11. The recording medium according to claim 1, wherein the low-molecular cationic substance includes hydrochlorides and acetates of laurylamine, coconut-amine, stearylamine, rosin-amine, lauryltrimethylammonium chloride, lauryldimethylbenzylammonium chloride, benzyltributylammonium chloride, benzalkonium chloride, cetylpyridinium chloride, cetylpyridinium bromide, 2-heptadecenyl-hydroxyethylimidazoline or dihydroxyethylstearylamine.

12. The recording medium according to claim 1, wherein the low-molecular cationic substance includes aluminum lactate, basic polyaluminum hydroxide, aluminum chloride, sodium aluminate or aluminum acrylate.

13. The recording medium according to claim 1, wherein the high-molecular cationic substance includes polyallylamine, polyallylamine hydrochloride, polyaminesulfonic acid, polyaminesulfonic acid hydrochloride, polyvinylamine, polyvinylamine hydrochloride, chitosan or chitosan acetate.

14. The recording medium according to any one of claims 1, 2 and 8 to 13, which is for use in ink-jet printing.

* * * * *